United States Patent [19]

Malachowski

[11] Patent Number: 4,542,614

[45] Date of Patent: Sep. 24, 1985

[54] STRUCTURAL MEMBERS WITH INTERLOCKED COMPONENTS

[75] Inventor: Frank Malachowski, Columbia Station, Ohio

[73] Assignee: Alcan Aluminum Corporation, Cleveland, Ohio

[21] Appl. No.: 452,886

[22] Filed: Dec. 27, 1982

[51] Int. Cl.[4] ..... E04C 1/10

[52] U.S. Cl. ..... 52/586; 52/731; 52/579

[58] Field of Search ..... 52/731, 586, 222, 579

[56] References Cited

U.S. PATENT DOCUMENTS

| | | | |
|---|---|---|---|
| 1,723,306 | 8/1929 | Sipe | 52/586 |
| 2,794,293 | 6/1957 | Milrod | 52/586 |
| 2,869,356 | 1/1959 | Kulhary | 52/586 |
| 3,382,639 | 5/1968 | Smith | 52/731 |
| 3,815,311 | 6/1974 | Nisula | 52/731 |

FOREIGN PATENT DOCUMENTS

| | | | |
|---|---|---|---|
| 688536 | 1/1967 | Belgium | 52/731 |

*Primary Examiner*—Henry E. Raduazo

*Attorney, Agent, or Firm*—Cooper, Dunham, Clark, Griffin & Moran

[57] ABSTRACT

A hollow structural member constituted of a plurality of wall sections cooperatively laterally enclosing an interior space, wherein adjacent wall sections have straight longitudinal edges aligned and facing each other to define a joint between the sections, with longitudinal recesses respectively formed on the inner surfaces of the wall sections adjacent the joint and opening toward each other across the joint, and wherein the sections are interlocked at the joint by means of an elongated spline inserted in the recesses for bridging the joint and having an outwardly projecting central longitudinal rib for engaging the joint-defining edges of the wall sections to limit the extent of lateral insertion of the spline into either of the recesses. A corner spline is also provided for interlocking wall sections at a joint at which the adjacent portions of the respective sections are substantially perpendicular to each other such that the included angle between their respective recess-bearing inner surfaces is about 270°.

6 Claims, 8 Drawing Figures

Fig. 1.
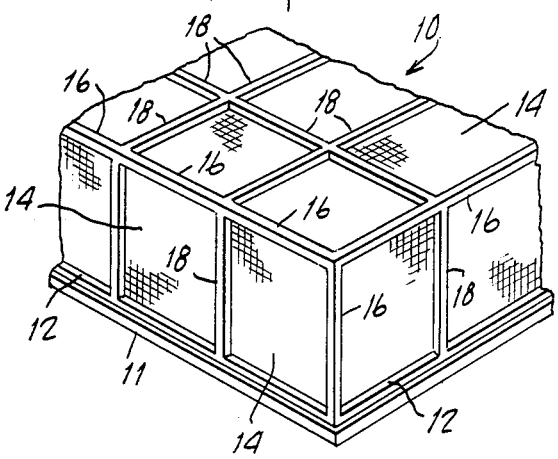
Fig. 4.
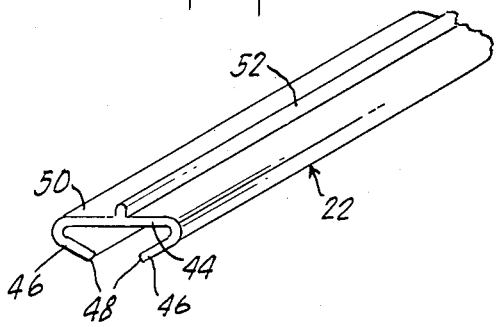
Fig. 2.
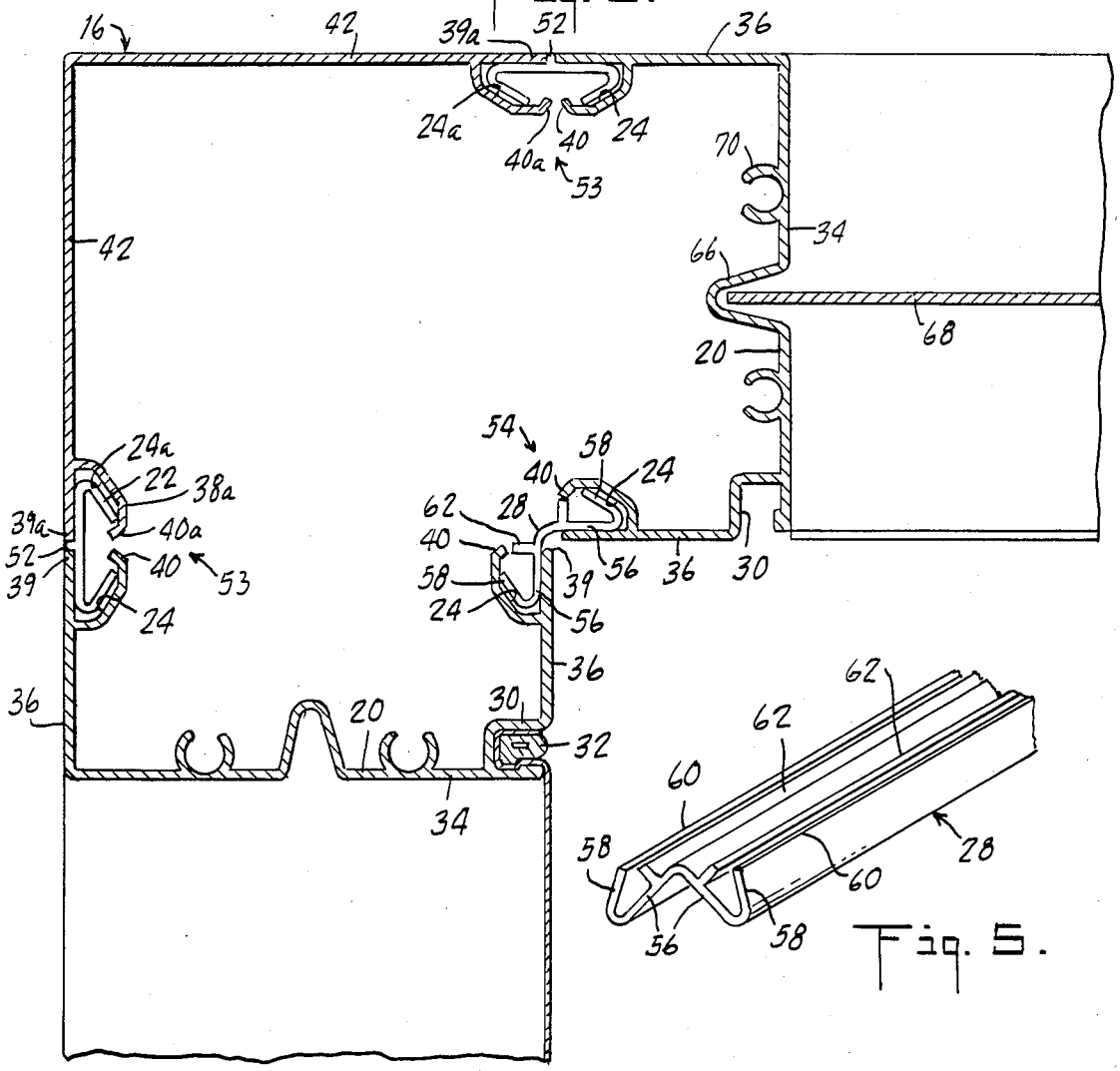
Fig. 5.

Fig. 3.
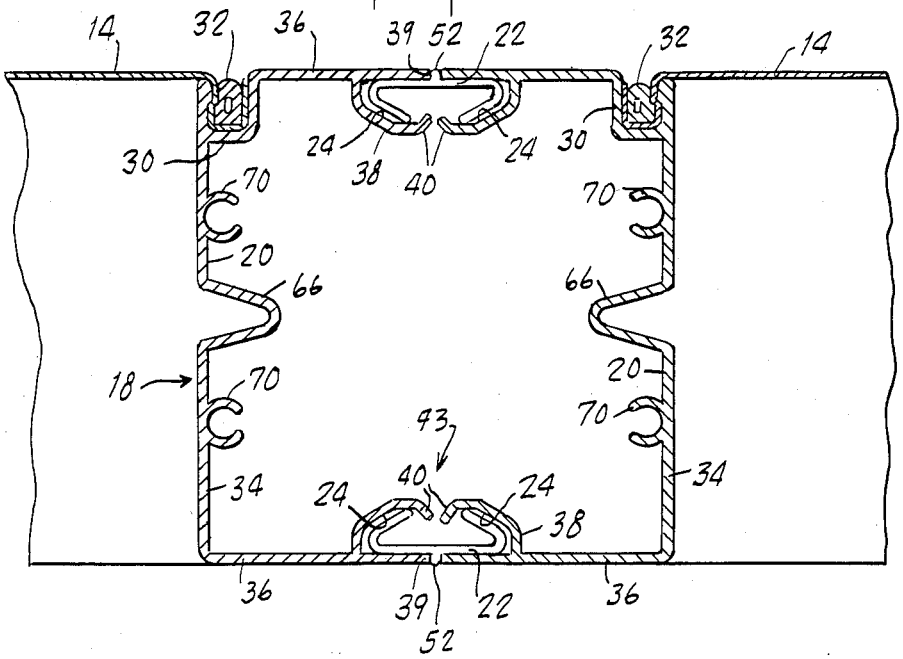
Fig. 6.
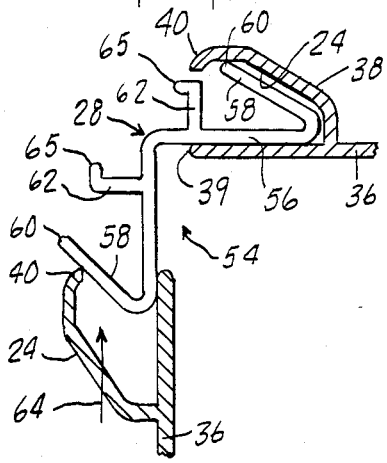
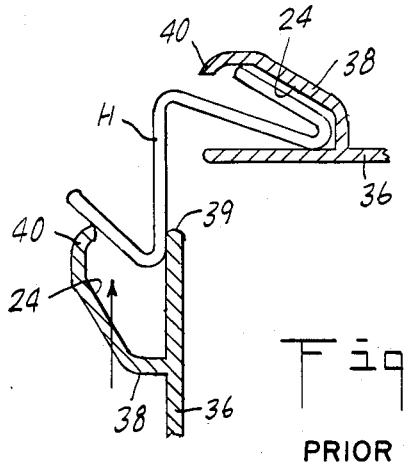
Fig. 8.
PRIOR ART
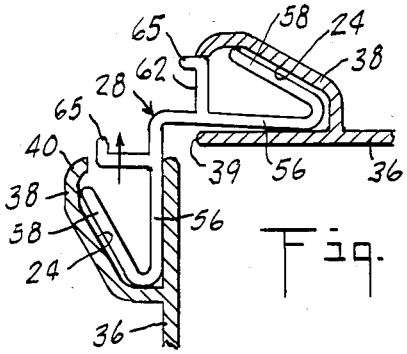
Fig. 7.

STRUCTURAL MEMBERS WITH INTERLOCKED COMPONENTS

BACKGROUND OF THE INVENTION

This invention relates to structural members, such as box beams, for building structures. More particularly, it relates to structural members constituted of interlocked components (e.g. channel sections or the like), and to interlocking elements therefor.

In U.S. Pat. No. 3,382,639, there is described a box beam construction comprising two identically dimensional, elongated, extruded rigid channel sections arranged with their channels opening toward each other and the longitudinal edges of their legs in abutting alignment to constitute joints between the channel sections. The inner surface of each channel leg, adjacent its edge, bears a longitudinal finger or lip projecting inwardly to define a generally V-shaped recess opening in the same direction as the channel, with a retaining shoulder formed along the free edge of the lip; thus, at each joint, there are two such recesses (i.e. one on each of the channel section legs that meet at the joint) opening toward each other across the joint. The channel sections are interlocked at the joints by means of elongated splines inserted in the recesses, each spline including a web portion bridging the joint inwardly of the channel section legs and a pair of spline legs extending inwardly from opposite sides of the spline web for respectively engaging the lips of the two recesses adjacent the joint behind their shoulders. It will be understood that terms such as "inner" or "inwardly," and "outer" or "outwardly," as used herein, refer respectively to directions toward and away from the interior of the box beam or other hollow structural member.

As an example of use of the described beams, the above-cited patent shows a screenroom enclosure wherein the beams serve as vertical wall posts and horizontal ceiling beams in a framework for supporting screen cloth panels stretched between the beams. The edges of the screen cloth panels are received in outwardly-opening longitudinal pockets formed in the channel sections that make up the beams, and are held in place by elongated plastic splines inserted in the pockets. Each beam at a corner of a wall or ceiling supports edges of two screen cloth panels lying in planes perpendicular to each other, while each of the other beams in the assembly supports edges of two screen cloth panels lying in a common plane.

A beam of the foregoing type is typically assembled by first inserting one side of one of the interlocking splines into a recess on one leg of a first one of the constituent channel sections, similarly inserting one side of the other spline into the other recess (i.e. on the other leg) of the same channel section, fitting the two recesses of the other channel section over the exposed sides of the two splines, and pressing the two channel sections together. With the known form of these elements, however, this assembly procedure has tended to force the splines so deeply into the recesses of the first channel section as to prevent proper engagement of the spline legs behind the shoulders of the lips of the second channel section. To avoid this difficulty, it has heretofore been necessary to manufacture the splines and channel sections to inconveniently and uneconomically close tolerances. A further problem encountered with the known design is that two specifically different channel sections (respectively having the screen-cloth-receiving pockets at different positions on their exteriors) have had to be produced for the corner posts and beams of a screen enclosure, in order properly to locate the screen cloth panels relative thereto.

SUMMARY OF THE INVENTION

The present invention is broadly directed to certain improvements in the general type of structural member which includes at least two wall portions each having a straight longitudinal free edge and a longitudinal lip diverging inwardly from the wall portion to define therewith a recess adjacent and opening toward the aforesaid wall portion free edge, the lip having an edge formed with a shoulder, and the respective longitudinal free edges of the two wall portions being disposed in proximate and parallel relation to each other so as to define a joint, with the recesses of the two wall portions respectively extending along opposite sides of the joint; and an elongated spline, insertable in the recesses, comprising a central portion or web for bridging the joint inwardly of the wall portions and two legs extending inwardly from opposite sides of the central portion of the spline for respectively engaging the recess-defining lips of the two wall portions behind their shoulders to interlock the wall portions at the joint. Typically, such a structural member is a hollow member comprising a plurality of (i.e. at least two) rigid wall sections cooperatively laterally enclosing an interior space, each wall section having two parallel straight longitudinal free edges each disposed in proximate parallel relation to a like edge of another of the wall sections to define a joint therewith, and the inner surface of each wall section bearing two of the aforementioned longitudinal lips, respectively disposed adjacent the two longitudinal free edges of the wall section so as to provide a spline-receiving recess extending along each of the latter edges. Illustrative of these members are the box beams described in the above-cited patent, wherein the constituent wall sections are the aforementioned channel sections, each of which has two legs or wall portions both having straight longitudinal free edges and both bearing inwardly diverging lips defining spline-receiving recesses.

In a first important aspect, in a structural member of the foregoing general type having at least one joint at which the proximate longitudinal edges of the wall portions are facing and the adjacent recesses open toward each other, the present invention contemplates the provision of a spline as aforesaid having a joint-bridging web, wherein a longitudinal rib is formed integrally with and projects outwardly from the spline web equidistantly from the sides thereof for engaging the facing longitudinal free edges of the wall portions at the joint to limit the extent of lateral insertion of the spline into either of the recesses. The invention in this aspect, as embodied (for example) in a box beam constituted of facing channel sections each having the general features of structure shown in the above-cited patent, overcomes the problem of excessively deep insertion of the spline in a recess of one channel section leg during assembly of the beam, because the rib acts as a stop, abutting the edge of the channel section leg, to limit the depth of such insertion; thus, the invention enables the channel sections and splines to be manufactured with the tolerances ordinarily observed for extrusions rather than with the extremely close dimensional tolerances heretofore required to assure proper assembly.

In a further aspect, the invention contemplates the provision of a structural member wherein at least one of the joints is defined between longitudinal free edges of wall portions or wall sections respectively having inner surfaces (adjacent the latter edges) oriented in substantially perpendicular planes such that the included angle between these inner surfaces adjacent the joint is about 270°, and the recesses extending along the joint (respectively defined by shoulder-bearing lips diverging inwardly from the last-mentioned inner surfaces) open at about 90° to each other. As a particular feature of the invention, the joint-bridging central portion of the spline for this joint is bent longitudinally at about 90° and bears two longitudinal ribs respectively projecting inwardly from the spline central portion toward the shoulders of the two recess-defining lips adjacent the joint, for engaging the shoulders to limit movement of the spline central portion toward the shoulders. The provision of this corner spline, with its ribs which facilitate assembly (by preventing dislodgment of a first-inserted side of the spline from one wall section recess during insertion of the other side of the spline into the other wall section recess), permits an advantageous diversity of arrangements of wall sections; for example, two identical channel sections can be joined with adjacent legs at right angles to each other, and if each of them has a screen-cloth receiving pocket formed in one leg, this arrangement enables them to be oriented to receive, respectively, edges of perpendicular screen cloth panels as at a corner of a wall or ceiling.

Further features and advantages of the invention will be apparent from the detailed description hereinbelow set forth, together with the accompanying drawings.

BRIEF DESCRIPTION OF THE DRAWINGS

FIG. 1 is a fragmentary perspective view of a screen room enclosure which includes structural members embodying the present invention in a particular form;

FIG. 2 is an enlarged cross-sectional view of a corner structural member of the type included in the enclosure of FIG. 1;

FIG. 3 is a similar view of a flat wall structural member of the type included in the enclosure of FIG. 1;

FIG. 4 is a fragmentary perspective view of a flat wall locking spline of the type incorporated in the structural members of FIGS. 2 and 3;

FIG. 5 is a similar view of a corner locking spline of the type incorporated in the structural member of FIG. 2;

FIGS. 6 and 7 are further enlarged fragmentary cross-sectional views of a portion of the structural member of FIG. 2, illustrating successive steps in the assembly of that structure; and FIG. 8 is a view similar to FIGS. 6 and 7 but showing a different (and hypothetical) form of corner spline, for purposes of comparison.

DETAILED DESCRIPTION

Referring to the drawings, the invention will be described as embodied in components of a screen room enclosure 10 (FIG. 1) of the general type shown in the aforementioned U.S. Pat. No. 3,382,639, comprising, on a floor 11, an assembly of sill members 12, upright structural members or wall posts, and horizontal structural members or ceiling beams, interconnected to constitute a rigid framework for supporting wall and ceiling panels 14 of screen cloth each stretched between adjacent sill members and posts and/or beams. Each of the posts at the corners of the vertical walls, and also each of the horizontal beams extending along the periphery of the ceiling, is a corner structural member 16 (FIG. 2) adapted to receive the margins of two screen cloth panels respectively extending therefrom in perpendicular planes, while each of the other posts and beams is a flat wall structural member 18 (FIG. 3) adapted to receive the margins of two screen cloth panels respectively extending in opposite directions therefrom but in a common plane. All the corner members 16 may be essentially identical; likewise, all the flat wall members 18 may be essentially identical, though differing (as explained below) from the members 16. The beams and posts are secured to each other at their ends, and the posts and sill members are secured to the floor, by means not material to the present invention.

In the illustrated embodiments of the invention, each of the members 16 and 18 is a hollow (box) member comprising an assembly of two or more elongated and axially rectilinear extruded rigid metal (e.g. aluminum) wall sections, secured together by elongated, stiffly resilient locking strips or splines (e.g. extruded vinyl strips) received in longitudinal recesses formed along facing edges of adjacent metal sections. Specifically, each member 18 (FIG. 3) is constituted of two identical metal box channel sections 20, disposed with their channels opening toward each other, and secured together by two flat wall vinyl locking splines 22 (FIG. 4) inserted in longitudinal recesses 24 formed along the edges of the channel sections. Each member 16 (FIG. 2) is constituted of two of the channel sections 20 disposed at right angles to each other (with their channels opening toward the interior of the member 16) and a right-angle section or cap 26 (which is also an extruded aluminum section) having its included angle opening toward the interior of the member 16; the two channel sections of the member 16 are secured to each other by a corner vinyl locking spline 28 (FIG. 5) inserted in the adjacent recesses 24 of the channel sections, and the cap 26 is secured to the channel sections by two of the flat wall locking splines 22 received in recesses **24*a* (identical to the recesses 24) formed along the longitudinal edges of the cap and in recesses 24 of the channel sections. Each sill member 12 may be a single channel section 20 disposed with its channel opening downwardly. The edges of the screen cloth panels 14 are received in longitudinal pockets 30 formed in the channel sections 20 and opening outwardly (i.e. away from the channels), and are retained therein by means of elongated splines 32**.

More particularly, each of the channel sections 20 is a rigid, relatively thick-walled aluminum extrusion having a central web 34 and longitudinal wall portions or legs 36, equal to each other in width, extending at right angles to the web in the same direction along opposite sides thereof. The pocket 30 is provided in one of the legs 36, at the juncture of the leg with the web. Formed integrally with each leg 36 is a longitudinal lip 38, projecting inwardly from and in diverging relation to the inner (i.e. channel-facing) surface of the leg adjacent the straight longitudinal free edge 39 of the leg so as to define therewith a generally V-shaped longitudinal recess 24 opening in the same direction as the channel of the section 20. The free edge of the lip 38 is shaped to constitute a shoulder 40 which projects toward the leg edge 39, such that the gap between the shoulder and the facing inner surface of the leg is less than the spacing between the portion of the lip adjacent the shoulder and the same leg inner surface, the shoulder 40 and edge 39 being equidistant from the web 34.

The cap or right-angle section 26 has two wall portions or arms 42 of equal width, each bearing a longitudinal lip 38*a* projecting from and in diverging relation to its inner surface adjacent its straight longitudinal free edge 39*a* to define therewith a generally V-shaped recess 24*a*. Each lip 38*a* terminates in a longitudinal shoulder 40*a* projecting toward the arm edge 39*a*, the dimensions, configuration and positional relation (to the adjacent edge 39*a*) of each recess 24*a* being identical to the dimensions, configuration and positional relation (to the adjacent edge 39) of each recess 24.

In the assembled flat wall member 18, each leg 36 of one of the two channel sections 20 is coplanar with a leg of the other channel section, and their respective facing edges 39 are closely adjacent and parallel (defining a joint 43 between the channel sections), such that their respective recesses 24 cooperatively constitute a longitudinal cavity for receiving a flat wall locking spline 22. This spline is an elongated, axially rectilinear extruded vinyl channel section having a flat central web 44 and two legs 46 extending toward each other, at acute angles (e.g. 45° angles) to the web 44, from opposite sides of the web. The legs 46 are stiffly resiliently depressible toward the web; in their unstressed condition, the dimension between their free edges 48 and the opposite surface 50 of the web 44 is greater than the width of the gap between the shoulder 40 of a recess 24 and the facing surface of the channel section leg 36, while the spacing between the two free edges 48 is greater than that between the respective shoulders 40 of two facing recesses 24 in the member 18 and the width of the spline 22 is less than the width of the cavity constituted by those recesses. Thus, the spline is positionable in the latter cavity with the edges 48 of its two legs 46 respectively behind the two shoulders 40 of the recesses constituting the cavity, so as to secure the adjacent legs 36 of the two channel sections 20 together, the web 44 of the spline then lying against the inner surfaces of these legs 36 within the cavity.

Insofar, the channel sections 20 and splines 22 of a member 18 are generally similar to the corresponding elements of the structural members described in the above-cited U.S. patent. With these elements, a member 18 is assembled by inserting one side of one spline into a recess 24 of one channel section 20, so that the leg 46 on that side of the spline is depressed under the recess shoulder 40, until the free edge 48 of the inserted spline leg passes beyond the shoulder and snaps into locking abutment with the lip 38 of that recess; similarly inserting one side of the other spline into the other recess 24 of the same channel section; respectively fitting the two recesses 24 of the other channel section over the exposed sides of the two splines; and pressing the two channel sections together until the free edges 48 of the second legs 46 of the spline pass beyond the shoulders 40, and snap into abutment with the lips 38, of the recesses of the second channel section, thereby locking the two channel sections together as shown in FIG. 3. A difficulty heretofore encountered in this assembly procedure has been that, unless the dimensions of the spline and the recess are controlled within inconveniently close tolerances, the first-inserted side of a spline has tended to become too deeply seated in its associated (first channel section) recess 24 to enable the shoulder 40 of the recess of the second channel section to pass lockingly over the free edge 48 of the leg 46 on the other side of the spline.

To overcome this problem, in accordance with the present invention and as a particular feature thereof, each flat wall locking spline 22 has a rectilinear longitudinal indexing rib 52 centered in and projecting outwardly from the outer surface 50 of the spline web 44. When one side of a spline 22 is inserted in a recess 24 of a channel section leg 36, the rib 52 comes into contact with the edge 39 of that leg as the free edge 48 of the inserted spline leg 46 passes beyond the shoulder 40 of the latter recess; i.e. the rib 52 acts as a stop, limiting the extent of insertion of the spline into the recess, and thereby ensuring that the spline will interlock effectively with the second channel section when a recess 24 of the second channel section is fitted over the spline. Since the rib 52 is centered in the spline web outer surface, it is immaterial which side of the spline is first inserted in a recess 24. In this way, satisfactory assembly of the member 18 can be readily and reliably achieved, using components (spline and channel sections) manufactured to normal tolerances for extruded material. The facing edges 39 of the assembled channel sections 20 in the member 18 are separated by the ribs 52, which preferably have a height about equal to the metal thickness of the legs 36 so as not to present substantial external discontinuities in the side surfaces of the member 18.

From FIG. 2, it will be seen that in the corner member 16, the locking interconnection of the cap 26 with the two channel sections 20 by means of splines 22 is identical to the above-described locking interconnection of the two channel sections in the member 18. Each arm 42 of the cap is coplanar with one leg 36 of one of the channel sections 20, and the recesses 24*a* and 24 of that arm and leg cooperatively constitute a cavity within which one of the splines 22 is positioned. The manner of assembly of each of these splined joints 53 can be essentially as described above with reference to the member 18; again, the presence of the rib 52 on the spline outer surface prevents excessively deep insertion of a spline 22 in either of the facing recesses 24 and 24*a*, and thereby affords assured satisfactory interlocking using components manufactured to ordinary extrusion tolerances. In the assembled member 16, the ribs 52 separate the edges 39*a* of the cap from the facing edges 39 of the channel sections.

The remaining joint 54 in the member 16 is that between the respective legs 36 of the two channel sections 20 which meet perpendicularly such that the included angle between their inner surfaces is 270° and their respective recesses 24 open at 90° to each other. The corner spline 28 employed at this right-angle joint is an elongated, axially rectilinear extruded vinyl W-section with a central portion longitudinally bent to provide two central arms 56 having an included central angle of 90° between them, and included acute angles between each central arm and the side leg 58 which diverges therefrom; the two side legs are resiliently depressible toward their respectively adjacent central arms, but in unstressed condition, the distance between the free edge 60 of each side leg 58 and the outer surface of the immediately subjacent central arm 56 is greater than the width of the gap between the shoulder 40 of a recess 24 and the facing surface of the channel section leg 36. The spline 28 is dimensioned to enable the two sides of the spline (each side constituting one leg 58 and the adjacent portion of its associated arm 56) to be simultaneously received, respectively, in the two recesses 24 of the right-angle joint 54, with the edge 60 of each leg 58 located behind the shoulder 40 so as to lock the spline in the recess whereby the spline interconnects the two channel section legs 36 at the joint 54. As in the case of the spline 22, when a side of the spline 58 is inserted in a recess 24, the inserted leg 54 is depressed by the recess shoulder 40 and snaps into locking position upon passing beyond the shoulder.

Each arm 56 bears an upstanding longitudinal rib 62, positioned to be in register with and to project toward the shoulder 40 of a recess 24 when the side of the spline including that arm is fully inserted within the recess, i.e. in the above-described locking position; thus, each rib 62 is spaced inwardly away from the free edge 60 of the adjacent leg 58. The height of the rib, however, is such that it does not ordinarily touch the shoulder 40. This rib 62 constitutes a further particular feature of the invention, in embodiments including the corner spline 58.

As will be understood from FIGS. 6–8, the rib 62 facilitates assembly of the joint 54. Initially, in such assembly, one side of the spline 28 is inserted into locking position within the recess 24 of one of the channel sections at that joint. The leg 36 of the other channel section is then positioned so that its recess 24 fits over the exposed side of the spline, and is pressed toward the center of the spline (in the direction of arrow 64, FIG. 6), so as to advance the shoulder 40 of the latter recess over the free edge 60 of the leg 58 on that side of the spline. The force thus exerted tends to deform the side of the spline already fully inserted in the first-mentioned recess 24, but such deformation is limited by abutment of the rib 62 on the first-inserted spline side with the adjacent recess shoulder 40 (FIG. 7), enabling completion of the assembly operation. If, in place of the spline 28, a spline H (lacking ribs 62, but otherwise identical to spline 28) were used, as shown in FIG. 8, the deforming effect of the later assembly steps on the first-inserted spline side would cause it to collapse and might consequently dislodge it from the recess in which it had previously been inserted.

Preferably, as indicated in FIGS. 6 and 7, the tip of each rib 62 is formed with a short transverse flangelike projection 65 extending along its length to provide an enlarged bearing surface for the shoulder 40 during assembly and to assure proper register between the rib and shoulder. The projection is perpendicular to the rib and oriented toward the center of the spline.

As shown in FIG. 3, the two channel sections 20 of the member 18 are so oriented, relative to each other, that their pockets 30 are located on the same side of the member 18. Each of these channel sections is shaped with a deep groove 66 in the center of its web 34, for strengthening purposes, and (if desired) to provide a mounting for a kick panel 68 illustrated in FIG. 2. Each channel section also has integral internal C-tubules 70 as are conventionally included in extruded elements to serve as runners for receiving screws or other fasteners (not shown), e.g. to interconnect adjacent structural members.

The described components of the structural members of the invention, including particularly the corner splines, afford an advantageous diversity of arrangements. For example, a structural member could be assembled from four of the channel sections 20, oriented at right angles to each other with their channels facing inwardly, and interconnected by corner splines 28 at each joint between adjacent channel sections.

It is to be understood that the invention is not limited to the features and embodiments hereinabove specifically set forth, but may be carried out in other ways without departure from its spirit.

I claim:

1. A hollow structural member comprising (a) a plurality of rigid wall sections cooperatively laterally enclosing an interior space, each of said wall sections having two parallel straight longitudinal free edges each disposed in proximate parallel relation to one of the longitudinal free edges of another of said wall sections to define therewith a joint between wall sections, (b) each of said wall sections having an inner surface bearing two longitudinal lips respectively disposed adjacent the longitudinal free edges of the wall sections and diverging inwardly from the inner surface thereof, each said lip defining with its associated wall section inner surface a recess opening toward the adjacent longitudinal free edge of the wall section, such that at each said joint there are two of said recesses respectively disposed on opposite sides of the joint and both opening toward the joint, each said lip having a free edge formed with a shoulder, and at least one of said joints being defined between longitudinal free wall section edges facing each other such that at said one joint, the recesses respectively disposed on opposite sides thereof open toward each other across the joint; and (c) means, receivable in the recesses adjacent the joints between wall sections, for interlocking the wall sections at said joints, said interlocking means including an elongated spline insertable in the recesses respectively disposed on opposite sides of said one joint and comprising a web for bridging said one joint inwardly of the wall sections adjacent said one joint and legs extending inwardly from opposite sides of said web for respectively engaging the lips defining the last-mentioned recesses behind their shoulders, (d) a longitudinal rib being formed integrally with and projecting outwardly from said web equidistantly from the sides thereof for engaging the facing longitudinal free wall section edges defining said one joint to limit the extent of lateral insertion of said spline into either of said last-mentioned recesses by acting as a stop for said lateral insertion;

(e) at least a second of said joints being defined between longitudinal free edges of wall sections respectively having inner surface portions, immediately adjacent said second joint, oriented in substantially perpendicular planes such that the included angle between them is about 270° and the recesses respectively disposed on opposite sides of said second joint open at about 90° to each other; and (f) said interlocking means further including a second elongated spline, insertable in the recesses respectively disposed on opposite sides of said second joint, comprising a central portion bent longitudinally at about 90° for bridging said second joint inwardly of said last-mentioned wall sections, and legs extending inwardly from opposite sides of said central portion for respectively engaging the lips defining the last-mentioned recesses behind their shoulders, said central portion bearing two longitudinal ribs respectively projecting inwardly therefrom toward the shoulders of the two last-mentioned lips for engaging the last-mentioned shoulders to limit movement of said central portion toward either of the last-mentioned shoulders.

2. A member as defined in claim 1, including at least three rigid wall sections, at least two of said wall sections comprising identical channel sections each including a central web and two parallel legs perpendicular to the channel section web, the longitudinal free edges of each channel section being the longitudinal edges of the legs thereof, each leg having an inner surface bearing one of said lips, and one leg of each channel section being formed to define a longitudinal outwardly opening pocket for receiving an edge of a screen cloth panel or the like, wherein said two channel sections are disposed with their channels opening toward said interior space and their respective pocket-defining legs positioned in perpendicular relation to each other with the respective longitudinal edges of said last-mentioned legs disposed in proximate parallel relation to each other to define said second joint.

3. A member as defined in claim 2, wherein said one joint is defined between longitudinal edges of two wall sections respectively having portions which are flat and coplanar adjacent said one joint.

4. In a structural member including (a) at least two generally planar wall portions, oriented substantially perpendicularly to each other such that the included angle between their inner surfaces is about 270°, and respectively having straight longitudinal free edges disposed in proximate parallel relation to each other to define a joint between the two wall portions, (b) each of said two wall portions bearing a longitudinal lip diverging inwardly from, and adjacent the longitudinal free edge of, the wall portion to define therewith a recess opening toward the last-mentioned free edge, such that the recesses of the two wall portions open at about 90° to each other, each of said lips having a free edge formed with a shoulder;

the improvement which comprises (c) an elongated spline insertable in said recesses, including a central portion bent longitudinally at about 90° for bridging said joint inwardly of said wall portions and legs extending inwardly from opposite sides of said central portion for respectively engaging said lips behind said shoulders to interlock said two wall portions at said joint, said central portion bearing two longitudinal ribs respectively projecting inwardly therefrom toward the shoulders of said lips for engaging said shoulders to limit movement of said central portion toward either of said shoulders.

5. For use in a structural member including at least two generally planar wall portions, oriented substantially perpendicularly to each other such that the included angle between their inner surfaces is about 270°, and respectively having straight longitudinal free edges disposed in proximate parallel relation to each other to define a joint between the two wall portions, each of said two wall portions bearing a longitudinal lip diverging inwardly from, and adjacent the longitudinal free edge of, the wall portion to define therewith a recess opening toward the last-mentioned free edge, such that the recesses of the two wall portions open at about 90° to each other, each of said lips having a free edge formed with a shoulder, an elongated spline insertable in said recesses, comprising (a) a central portion bent longitudinally at about 90° for bridging said joint inwardly of said wall portions and (b) legs extending inwardly from opposite sides of said central portion for respectively engaging said lips behind said shoulders to interlock said two wall portions at said joint, (c) said central portion bearing two longitudinal ribs respectively projecting inwardly therefrom toward the shoulders of said lips for engaging said shoulders to limit movement of said central portion toward either of said shoulders.

6. A spline as defined in claim 5, wherein each of said ribs has a tip formed with a transverse projection extending along the length of the rib to provide an enlarged bearing surface for assured engagement with a shoulder as aforesaid.

* * * * *